US010145659B1

(12) United States Patent
Osienski et al.

(10) Patent No.: US 10,145,659 B1
(45) Date of Patent: Dec. 4, 2018

(54) RAPIDLY DEPLOYABLE SINGLE NET CAPTURE MARINE BARRIER SYSTEM

(71) Applicant: HALO Maritime Defense Systems, Inc., Newton, NH (US)

(72) Inventors: Michael J. Osienski, Londonderry, NH (US); Judson DeCew, Rochester, NH (US); Sean Gribbin, Newton, NH (US); Tom Sherwin, Newton, NH (US)

(73) Assignee: HALO MARITIME DEFENSE SYSTEMS, INC., Newton, NH (US)

( * ) Notice: Subject to any disclaimer, the term of this patent is extended or adjusted under 35 U.S.C. 154(b) by 0 days.

(21) Appl. No.: 15/686,566

(22) Filed: Aug. 25, 2017

(51) Int. Cl.
*E02B 3/04* (2006.01)
*F41H 11/05* (2006.01)
*E02B 3/20* (2006.01)

(52) U.S. Cl.
CPC ..... *F41H 11/05* (2013.01); *E02B 3/04* (2013.01); *E02B 3/20* (2013.01)

(58) Field of Classification Search
CPC ..... E02B 3/04; B63G 9/04; F41H 11/05
See application file for complete search history.

(56) References Cited

U.S. PATENT DOCUMENTS 1,158,555 A 11/1915 Prescott
1,278,970 A 9/1918 Maxwell
1,299,243 A 4/1919 Sheransky
2,041,662 A 5/1936 Mapes
2,693,161 A 11/1954 Stubbs
2,716,959 A 9/1955 Betts
3,020,567 A 2/1962 Colt
3,077,614 A * 2/1963 Lloyd ..... B63B 22/02 114/230.2
3,185,445 A 5/1965 Broadway
3,499,291 A 3/1970 Mikkelsen
3,604,389 A 9/1971 Roberts et al.
3,823,680 A 7/1974 Straumsnes
3,864,049 A 2/1975 Ono
4,033,137 A 7/1977 Geist
(Continued)

FOREIGN PATENT DOCUMENTS

WO 02/26019 4/2002

OTHER PUBLICATIONS

International Search Report and Written Opinion issued in International Patent Application No. PCT/US2012/053094 dated Nov. 20, 2012.

(Continued)

*Primary Examiner* — Sean D Andrish
(74) *Attorney, Agent, or Firm* — Miles & Stockbridge P.C.

(57) ABSTRACT

A marine barrier has a line of buoyant column modules, and an impact net attached to and extending between the column modules. First and second lines of buoyant flotation modules are respectively disposed parallel to and on opposing sides of the line of column modules, and are connected to the column modules by legs such that each of the flotation modules is retained between two adjacent ones of the center column modules. When the barrier is floating in a body of water and a moving vessel impacts the impact net, the impact net deflects to transfer a force of the impact to one or more of the column modules and flotation modules, which in turn engage the water to transfer the force of the impact to the water, to arrest the motion of the vessel.

21 Claims, 16 Drawing Sheets

(56) References Cited

U.S. PATENT DOCUMENTS

| | | | | |
|---|---|---|---|---|
| 4,174,185 | A | 11/1979 | Toki | |
| 4,272,214 | A | 6/1981 | Nyfeldt et al. | |
| 4,319,858 | A | 3/1982 | Jaffrennou et al. | |
| 4,425,053 | A | 1/1984 | Mute et al. | |
| 5,062,739 | A | 11/1991 | Klockner | |
| 5,141,359 | A | 8/1992 | Klockner | |
| 5,179,907 | A | 1/1993 | Galbraith | |
| 5,429,452 | A | 7/1995 | Frost | |
| 5,651,709 | A | 7/1997 | Nandakumar et al. | |
| 5,827,011 | A | 10/1998 | Kann | |
| 5,980,159 | A | 11/1999 | Kazim | |
| 6,102,616 | A | 8/2000 | Foote | |
| 6,591,774 | B2 | 7/2003 | Metherell et al. | |
| 6,655,641 | B2 | 12/2003 | Sherman et al. | |
| 6,681,709 | B1 | 1/2004 | Nixon | |
| 6,843,197 | B1 | 1/2005 | Nixon et al. | |
| 6,860,209 | B2 | 3/2005 | McKoy | |
| 6,877,456 | B2 | 4/2005 | Metherell et al. | |
| 6,886,484 | B2 | 5/2005 | Thomas | |
| 6,960,047 | B2 | 11/2005 | Knezek et al. | |
| 6,980,483 | B2 | 12/2005 | McDonald | |
| 7,140,599 | B1 | 11/2006 | Spink | |
| 7,401,565 | B2 | 7/2008 | Nixon et al. | |
| 7,451,527 | B2 | 11/2008 | Pearce et al. | |
| RE40,616 | E | 1/2009 | Nixon | |
| 7,481,176 | B2 | 1/2009 | Pratt et al. | |
| 7,524,139 | B2 | 4/2009 | Bishop | |
| 7,524,140 | B2 | 4/2009 | Bishop | |
| 7,572,083 | B1 | 8/2009 | Bishop et al. | |
| 7,726,910 | B2 | 6/2010 | Foo et al. | |
| 7,744,313 | B2 | 6/2010 | Terai et al. | |
| 7,887,254 | B2 | 2/2011 | Bishop | |
| 7,975,639 | B2 | 7/2011 | Bishop | |
| 8,007,202 | B2 | 8/2011 | Davis et al. | |
| 8,020,836 | B2 | 9/2011 | Bishop | |
| 8,844,114 | B2 * | 9/2014 | Butterfield | E05D 5/14 29/525.01 |
| 8,920,075 | B2 | 12/2014 | Bishop | |
| 9,683,342 | B2 | 6/2017 | Bishop | |
| 2003/0190191 | A1 | 10/2003 | Clark | |
| 2004/0018055 | A1 | 1/2004 | Clark et al. | |
| 2004/0018060 | A1 | 1/2004 | Knezek et al. | |
| 2004/0115002 | A1 | 6/2004 | Meeks et al. | |
| 2005/0013668 | A1 | 1/2005 | Nixon et al. | |
| 2005/0058509 | A1 | 3/2005 | Steinberg | |
| 2005/0191129 | A1 | 9/2005 | Yodock et al. | |
| 2006/0034668 | A1 | 2/2006 | Knezek et al. | |
| 2006/0037526 | A1 | 2/2006 | Knezek et al. | |
| 2006/0216116 | A1 | 9/2006 | Baker | |
| 2007/0102689 | A1 | 5/2007 | Alberson | |
| 2008/0105184 | A1 | 5/2008 | Nixon | |
| 2008/0267717 | A1 | 10/2008 | Meyers et al. | |
| 2008/0279631 | A1 | 11/2008 | Bishop | |
| 2009/0035068 | A1 | 2/2009 | Terai et al. | |
| 2009/0090059 | A1 | 4/2009 | Bishop | |
| 2010/0059728 | A1 | 3/2010 | Bishop | |
| 2010/0178109 | A1 | 7/2010 | Wilson | |
| 2010/0239374 | A1 | 9/2010 | Davis et al. | |
| 2013/0108368 | A1 | 5/2013 | Bishop | |
| 2013/0119334 | A1 * | 5/2013 | Bishop | B63G 9/04 256/26 |

OTHER PUBLICATIONS

International Search Report and Written Opinion issued in International Patent Application No. PCT/2012/052655 dated Nov. 6, 2012.

International Preliminary Report dated Mar. 4, 2014 in PCT/US2012/053094.

International Search Report and Written Opinion issued in International Patent Application No. PCT/US2014/067524 dated Feb. 25, 2015.

International Search Report and Written Opinion issued in International Patent Application No. PCT/US2014/067558 dated Feb. 24, 2015.

* cited by examiner

RAPIDLY DEPLOYABLE SINGLE NET CAPTURE MARINE BARRIER SYSTEM

TECHNICAL FIELD

The present subject matter relates to marine barriers and movable gates. The present disclosure has particular applicability to marine barriers for arresting the motion of a vessel impacting the barrier.

BACKGROUND

Structures for use on both land and/or water as security barrier systems have been previously developed. Such structures generally intend to stop intruding objects, and range from thick, solid walls blocking the object's progress to secured areas for disabling the propelling mechanism of the object. These structures commonly exhibit noticeable shortcomings. First, these structures are often cumbersome and time-consuming to install and erect as and where desired. Second, they are difficult, or even impossible, to maintain and/or repair after they have sustained the impact of an intruding object. Third, they are often not adaptable to different needs and conditions.

One solution providing an improved marine barrier is disclosed in U.S. Pat. No. 8,920,075, which is hereby incorporated by reference in its entirety. The marine barrier of the '075 patent includes two continuous pleated rows of first and second respective pluralities of buoyant panels, to form a diamond-shaped barrier. A plurality of hinges elastically connect opposing sides of adjacent panels with an included angle therebetween to form two continuous pleated rows, and the hinges are arranged in first, second, and third substantially parallel rows. A first plurality of impact cables (or an impact net) are attached to opposing ends of the first pleated row of panels and pass through each of the hinges in the first row of hinges. A second plurality of impact cables (or an impact net) are attached to opposing ends of the second pleated row of panels and pass through each of the hinges in the third row of hinges. When the barrier is floating in water and a moving vessel impacts the first or second plurality of impact cables, those impact cables deflect to transfer a force of the impact to one or more of the panels, which in turn engage the water to transfer the force of the impact to the water, to arrest the motion of the vessel. In other words, during an impact the panels are drawn in around the point of impact and engage the water to dissipate the impact force.

The marine barrier of the '075 patent is a vast improvement over previous barriers, but is designed to be a permanent structure, and is designed to have a very high level of effectiveness. Consequently, it may be unnecessarily large, heavy, and/or costly for temporary applications, for deployment in remote areas, or for lower-performance applications that do not require its effectiveness or its built-in redundancies.

In another type of barrier intended to be simpler and lower-cost, a single impact net is strung between central columns in what is referred to as a "single net capture mechanism," in contrast to the two-net capture mechanism of the '075 patent, which has a set of impact nets or cables attached to each of the front and rear faces of the barrier. A single net capture system is disclosed in U.S. Pat. No. 9,683,342, which is hereby incorporated by reference in its entirety. The marine barrier 200 of the '342 patent, one embodiment of which is shown in FIGS. 8a-b, includes a series of central columns 205 arranged in a line, which support an impact net 210 strung between them. As best seen in FIG. 8b, the central substantially vertical columns 205 are joined to each other and supported in the water by frames, each having a lower horizontal leg 220 attached to a lower portion of the column 205 and a diagonal strut 225 also attached to the column 205. Each leg includes a float 230. The legs 220 and floats 230 are arranged such that a distal end of each of the legs 220 is attachable to a distal end of a corresponding leg 220 of an adjacent column 205 to form a series of diamond-shaped supports between the columns 205, to support the columns 205 and the impact net 210 when the barrier 200 is floating in a body of water. The combination of a column 205 and four frames 215 is referred to hereinafter as a "column module."

When the barrier 200 is floating in the body of water and a moving vessel 235 impacts the impact net 210, the impact net 210 deflects to transfer a force of the impact to one or more of the column modules (see arrows L), which in turn engage the water to transfer the force of the impact to the water, to arrest the motion of the vessel 235. The barrier 200 can be folded for portability such that the legs 220 are substantially parallel to each other, because the legs 220, struts 225, and columns 205 are joined to each other via elastic hinges 255, 265.

Although the single net barrier of the '342 patent is lighter and more easily portable than previous barriers, its folding legs and struts add cost, complexity, and size when folded, while lowering the system's overall strength. Additionally, its floats are on each of its horizontal legs (four legs for each column module), creating a large water plane area, which tends to make the system unstable in large wave events.

There exists a need for an effective marine barrier that is low cost, simple, and easily portable.

SUMMARY

The present disclosure provides a marine security barrier system that addresses the aforementioned needs.

Embodiments include a marine barrier comprising a plurality of center column modules spaced apart from each other and arranged in a linear fashion, each having a substantially vertical center column beam and a buoyant portion. An impact net is attached to each of the center column beams and extends between the plurality of center column modules. A first plurality of flotation modules is spaced from each other and arranged in a linear fashion such that they are substantially parallel to the plurality of center column modules. The barrier further comprises a first plurality of legs, each leg for connecting one of the first plurality of flotation modules to one of the center column modules. Each of the first plurality of flotation modules has a pair of the first plurality of legs extending outwardly therefrom in opposing directions with an included angle therebetween, such that each of the first plurality of flotation modules is retained between two adjacent ones of the center column modules and offset from the longitudinal axis of the line of center column modules in a first direction.

A second plurality of flotation modules is spaced from each other and arranged in a linear fashion such that the second plurality of flotation modules is substantially parallel to the plurality of center column modules. A second plurality of legs is provided, each leg for connecting one of the second plurality of flotation modules to one of the center column modules. Each of the second plurality of flotation modules has a pair of the second plurality of legs extending outwardly therefrom in opposing directions with the included angle therebetween, such that each of the second plurality of flotation modules is retained between two adjacent ones of the center column modules and offset from the longitudinal axis of the line of center column modules in a second direction opposite the first direction.

Each of the first and second pluralities of flotation modules includes a buoyant portion. When the barrier is floating in a body of water and a moving vessel impacts the impact net, the impact net deflects to transfer a force of the impact to one or more of the center column modules, first plurality of flotation modules, and second plurality of flotation modules, which in turn engage the water to transfer the force of the impact to the water, to arrest the motion of the vessel.

Embodiments also include the barrier wherein each leg of the first and second pluralities of legs is for movably connecting one of the flotation modules to one of the center column modules, such that the barrier is movable from an expanded position where adjacent ones of the legs are disposed with the included angle therebetween, to a retracted position where the legs are substantially parallel to each other.

Embodiments further include a rapidly deployable marine barrier system comprising the barrier described immediately above, and a lifting cage for storing the barrier when the barrier is in the retracted position.

Objects and advantages of embodiments of the disclosed subject matter will become apparent from the following description when considered in conjunction with the accompanying drawings.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

Figure 1A:
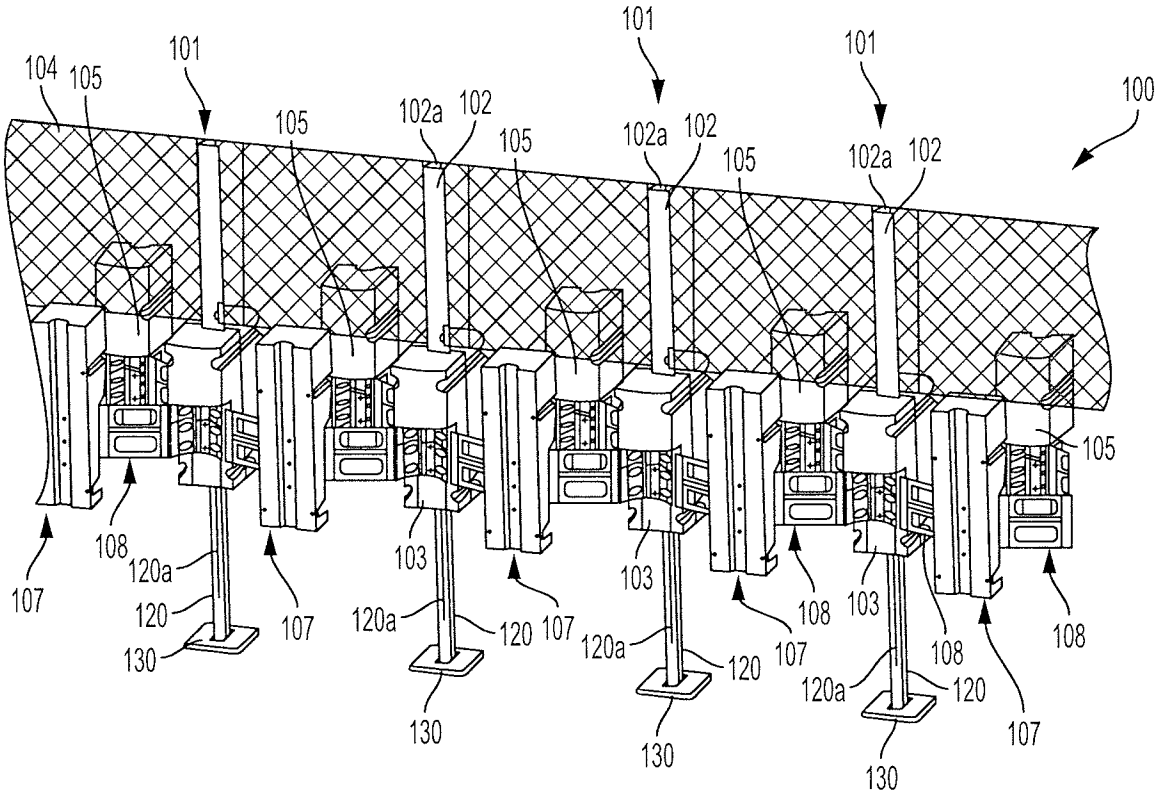
FIG. 1*a* is a perspective view of a marine barrier according to an embodiment of the present disclosure.

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

Disclosed herein are marine barrier and gate systems. In the disclosed barrier and gate systems, a single impact net is strung between central columns in what is referred to as a "single net capture mechanism." The disclosed single net capture system is simpler, more stable, and more easily foldable and ship-able than prior such systems shown in FIGS. 8*a-b*, as will be explained in detail herein below.

As shown in FIGS. 1*a-d*, one embodiment of the disclosed single net capture system 100 includes a plurality of center column modules 101, each having a substantially vertical center column beam 102 and a buoyant portion 103. The center column modules 101 are spaced apart from each other and arranged in a linear fashion. An impact net 104 is attached to each of the center column beams 102 and extends between the plurality of center column modules 101. Impact net 104 can extend between about 48 and 72 inches above buoyant portions 103, and center column modules 101 are spaced about 15 to 72 inches apart from each other. Impact net 104 comprises steel wire rope or fiber rope; for example, ultra-high-molecular-weight polyethylene (UHMWPE). Center column beams 102 comprise a metal, a pultruded composite, or a plastic; for example, high density polyethylene (HDPE) or a glass filled plastic. The buoyant portions 103 of the center column modules 101 each comprise high density foam or a foam-filled plastic shell (e.g., an HPDE shell).

Figure 1B:
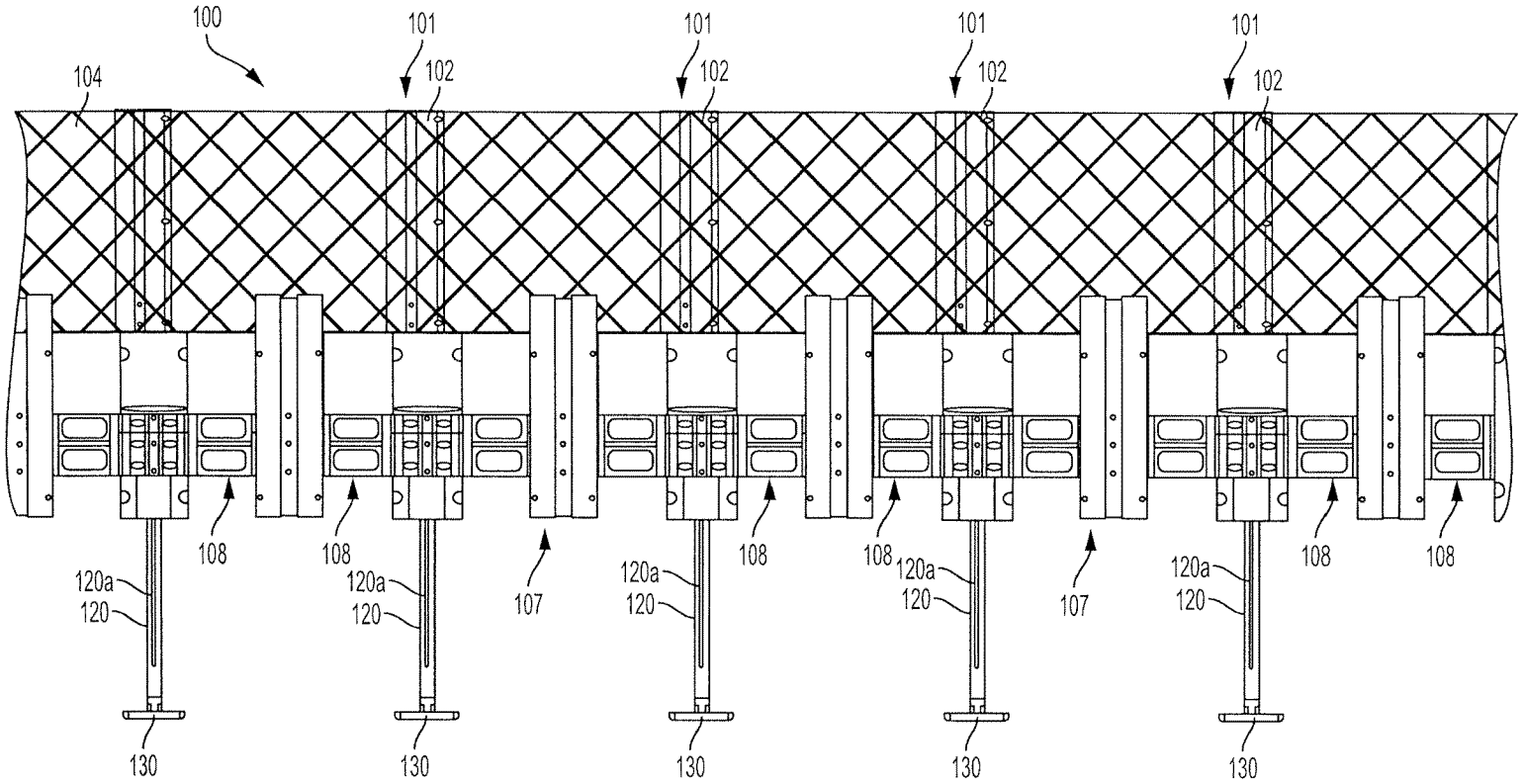
FIG. 1*b* is a front view of the barrier of FIG. 1.
Figure 1C:
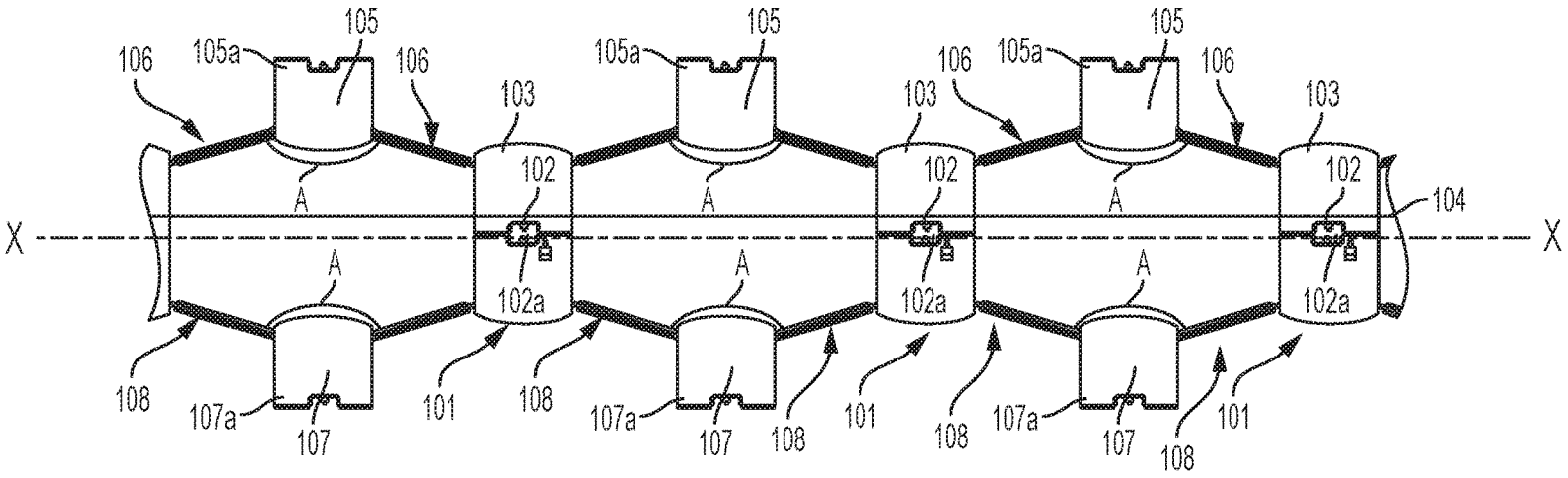
FIG. 1*c* is a top view of the barrier of FIG. 1.

As best seen in FIG. 1*c*, the center column modules 101 are joined to each other and supported in the water by two rows of flotation modules arranged parallel to the center column modules 101. More particularly, a first plurality of flotation modules 105, each including a buoyant portion 105*a*, is spaced from each other and arranged in a linear fashion such that the first plurality of flotation modules 105 is substantially parallel to the plurality of center column modules 101. A first plurality of legs 106 is provided, each leg 106 connecting one of the first plurality of flotation modules 105 to one of the center column modules 101. Each of the first plurality of flotation modules 105 has a pair of the first plurality of legs 106 extending outwardly therefrom in opposing directions with an included angle A therebetween, such that each of the first plurality of flotation modules 105 is retained between two adjacent ones of the center column modules 101 and offset from the longitudinal axis X-X of the line of center column modules 101 in a first direction.

Likewise, a second plurality of flotation modules 107, each including a buoyant portion 107*a*, is spaced from each other and arranged in a linear fashion such that the second plurality of flotation modules 107 is substantially parallel to the plurality of center column modules 101. A second plurality of legs 108 is provided, each leg 108 for connecting one of the second plurality of flotation modules 107 to one of the center column modules 101. Each of the second plurality of flotation modules 107 has a pair of the second plurality of legs 108 extending outwardly therefrom in opposing directions with the included angle A therebetween, such that each of the second plurality of flotation modules 107 is retained between two adjacent ones of the center column modules 101 and offset from the longitudinal axis X-X of the line of center column modules 101 in a second direction opposite the first direction.

The value of included angle A depends on the length of the legs 106, 108, which can vary depending on environmental and site-specific requirements, as discussed herein below. Generally, legs 106, 108 can be from 17 to 24 inches long, resulting in each pair of corresponding flotation modules 105, 107 being spaced about 15 to about 66 inches apart.

Similar to the buoyant portions 103 of the center column modules 101, the buoyant portions 105*a*, 107*a* of the first and second pluralities of flotation modules 105, 107 comprise high density foam or a foam-filled plastic shell (e.g., an HPDE shell).

When the barrier 100 is floating in a body of water and a moving vessel impacts the impact net 104, the impact net 104 deflects to transfer a force of the impact to one or more of the center column modules 101, first plurality of flotation modules 105, and second plurality of flotation modules 107, which in turn engage the water to transfer the force of the impact to the water, to arrest the motion of the vessel.

Figure 2:
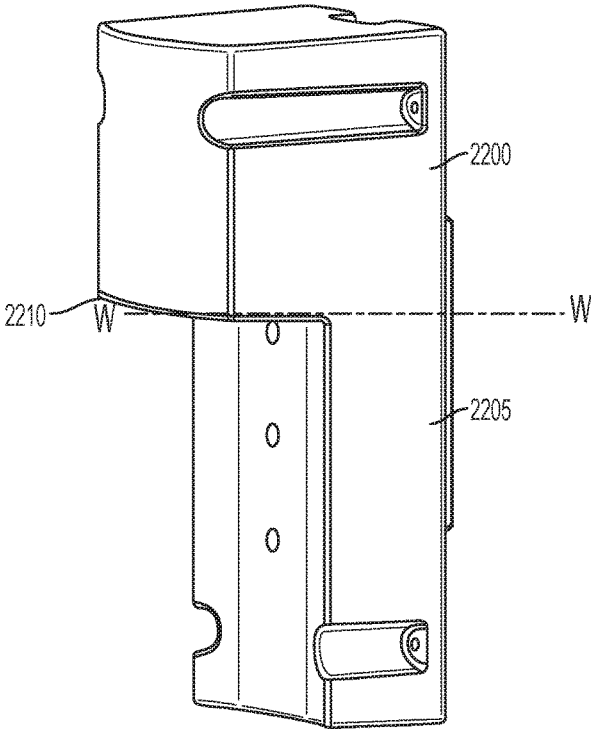
FIG. 2 is a perspective view of a buoyant portion of the barrier of FIG. 1.
Figure 8A:
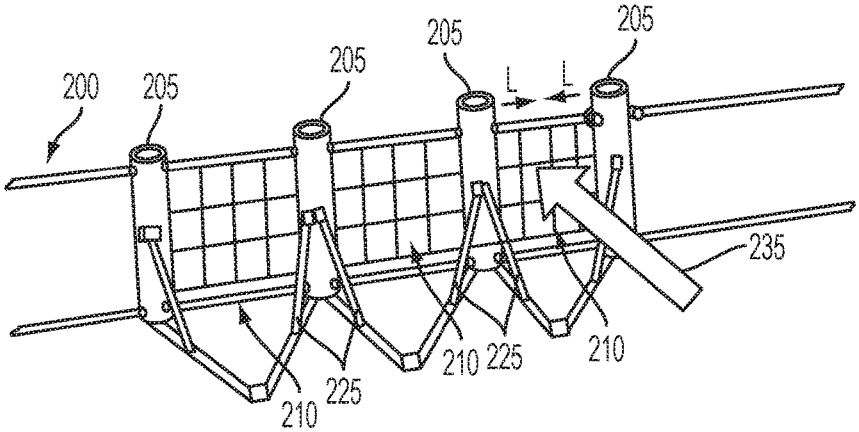
FIG. 8a PRIOR ART
FIGS. 8*a* and 8*b* are perspective and top views, respectively, of a prior art marine barrier.
Figure 8B:
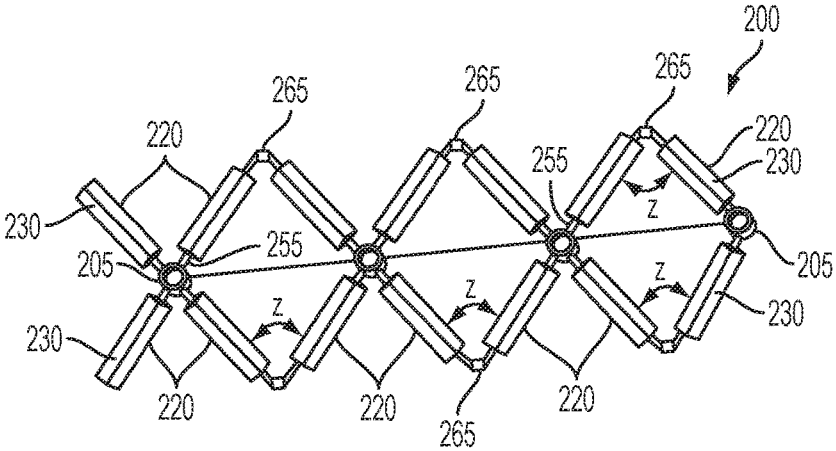
FIG. 8b PRIOR ART

As shown in FIG. 2, each of the buoyant portions 103, 105*a*, 107*a* of the plurality of center column modules and the first and second pluralities of flotation modules advantageously includes an upper portion 200 which is disposed above a waterline W of the barrier 100 when the barrier is floating in the body of water, and a lower portion 205 disposed below the waterline W. In certain embodiments, the buoyant portions have a volume of about 3.5 to 4.0 $ft^3$. The buoyant portions 103 of the center column modules 102 are typically sized such that they are completely below the impact net 104. The upper portion 200 has a greater volume than the lower portion 205, to provide a righting moment for the barrier. In certain embodiments, waterline W is right below the "lip" 210 of the buoyant portion. The lower portion 205 is 30-40% of the volume of the buoyant portion, and is for providing buoyancy for the barrier 100. The upper portion 200 is 60-70% of the volume of the buoyant portion, and is for providing reserve buoyancy to optimize the barrier's righting moment. Additionally, the disclosed system's stability is increased over previous single net capture systems, such as shown in FIG. 8*a-b*, because the buoyant portions 103, 105*a*, 107*a* are respectively located at the center and outboard parts of barrier 100.

Figure 1E:
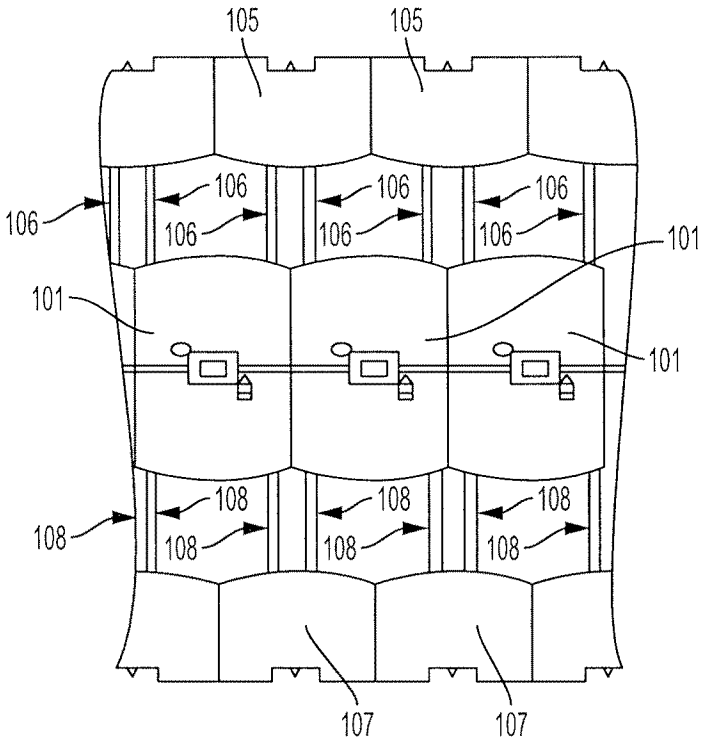
FIG. 1*e* is a top view of the barrier of FIG. 1 in a retracted position.
Figure 1D:
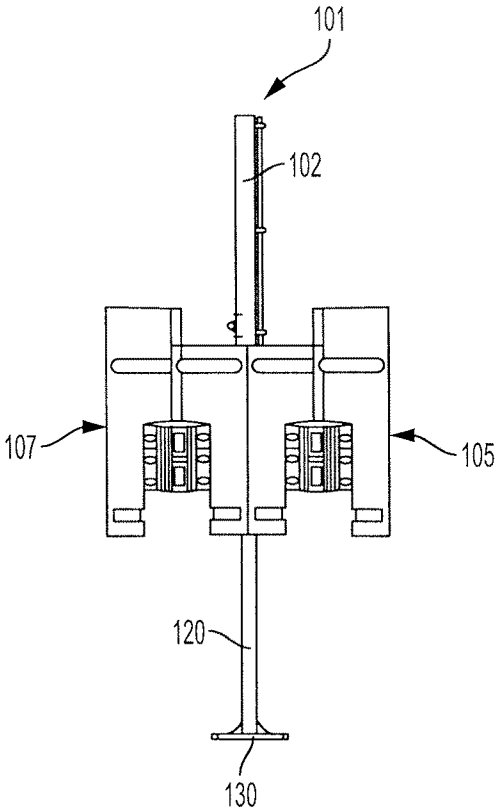
FIG. 1*d* is a side view of the barrier of FIG. 1.
Figure 6:
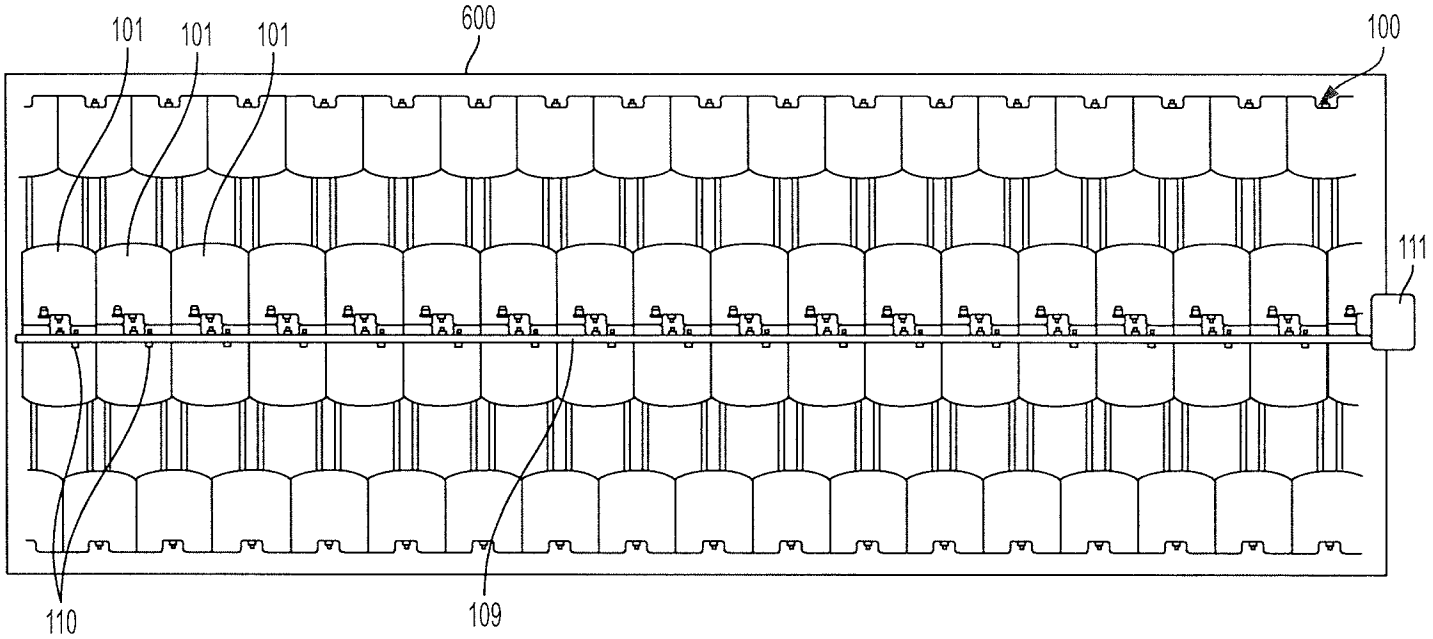
FIG. 6 is a top view of the barrier of FIG. 1 in a retracted position inside a container.

Each leg 106, 108 of the first and second pluralities of legs is for movably connecting one of the flotation modules 105, 107 to one of the center column modules 101 such that the barrier 100 is movable from an expanded position (best seen in FIG. 1*c*) where adjacent ones of the legs 106, 108 are disposed with the included angle A therebetween, to a retracted position shown in FIG. 1*e* where the legs 106, 108 are substantially parallel to each other. In certain embodiments shown in FIG. 6, movement from the expanded position to the retracted position is accomplished by attaching a cable or line 109 to a first end one of the center column modules 101 and passing it through a fairlead 110 of one of more of the other center column modules 101 to a conventional capstan or winch 111. Capstan/winch 111 is used to draw in cable 109 to retract barrier 100, or vice versa. This expansion/retraction feature of the disclosed barrier enables it to be used as a marine gate. The provision of cable 109, fairleads 110, and winch 111 enable the expansion and retraction of barrier 100 to be automated. Additionally, as discussed in detail herein below, it enables the barrier to be easily portable.

Figure 3A:
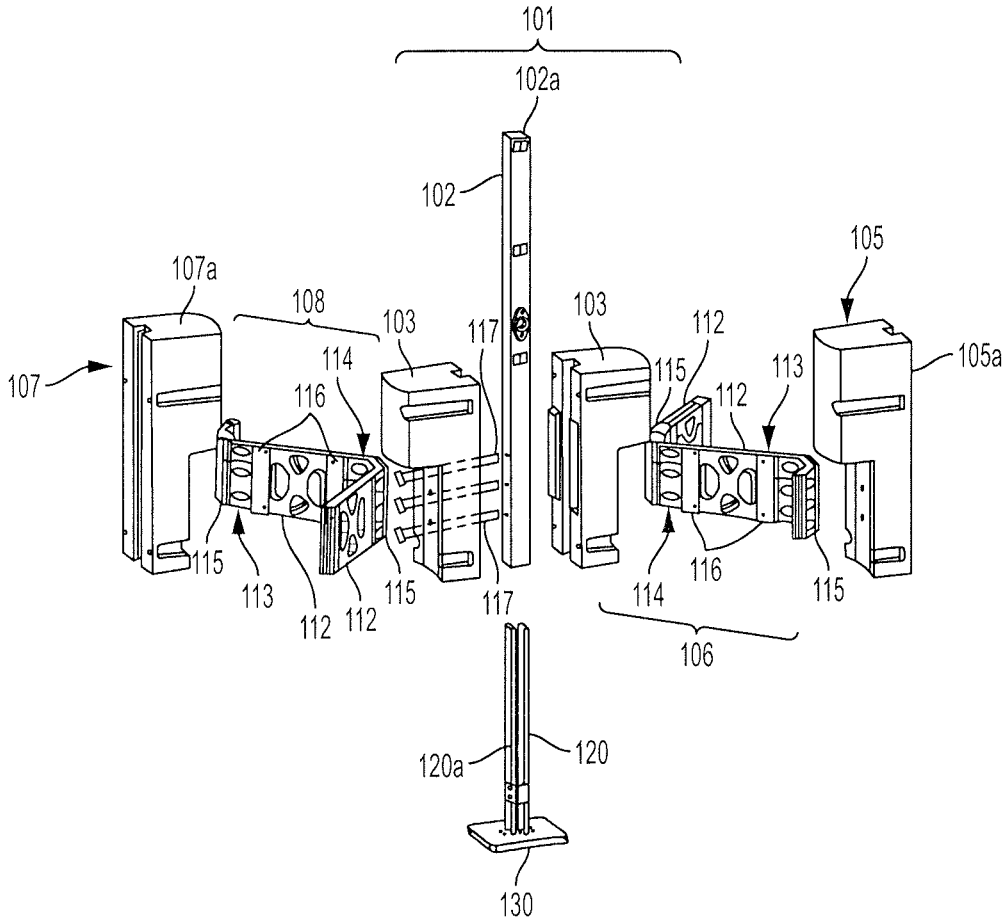
FIG. 3*a* is an exploded perspective view of a portion of the barrier of FIG. 1.
Figure 3B:
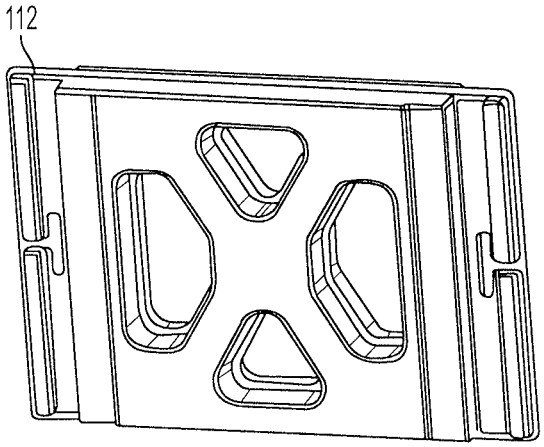
FIGS. 3*b* and 3*c* are perspective views of two types of hinge panels usable with the marine barriers of the present disclosure.
Figure 3C:
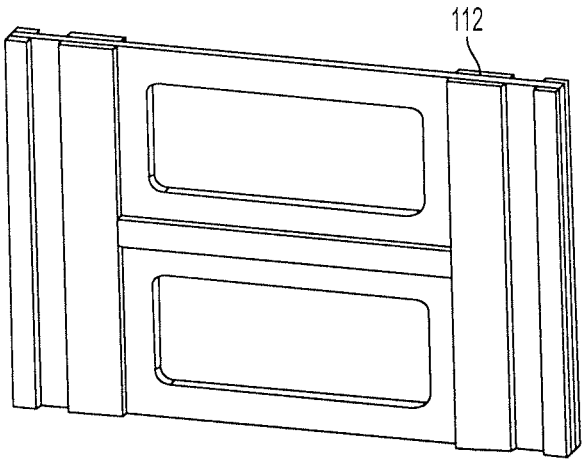

Referring now to FIGS. 3*a* to 3*g*, each leg 106, 108 of the first and second pluralities of legs comprises a hinge panel 112, which in some embodiments comprises a twin sheet thermoplastic as shown in FIG. 3*b*. It could also be rotational molded or injection molded. In other embodiments, hinge panel 112 comprises a composite, an injection molded plastic (e.g., HDPE), or a metal, as shown in FIG. 3*c*. As shown in FIG. 3*a*, a first hinge 113 is provided for elastically connecting a first end of the hinge panel 112 to one of the flotation modules 105, 107, and a second hinge 114 for elastically connecting a second end of the hinge panel 112 to the buoyant portion 103 of one of the center column modules 101. In this embodiment, hinges 113 and 114 are identical.

Figure 3E:
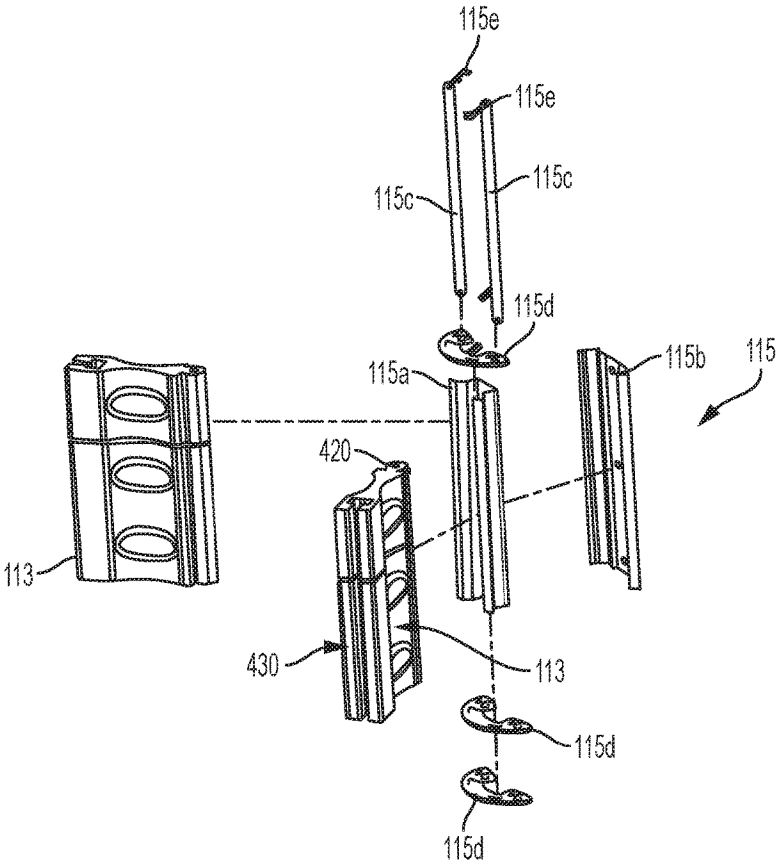
FIG. 3*e* is an exploded perspective view of the V-hinge assembly of FIG. 3*d*.
Figure 3D:
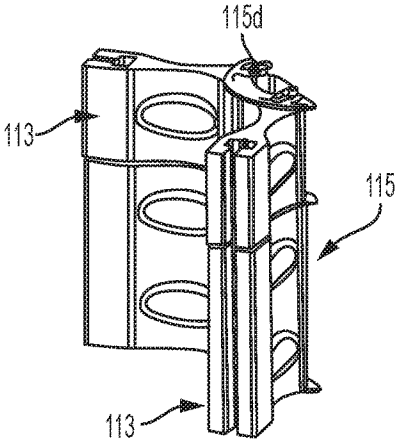
FIG. 3*d* is a perspective view of a V-hinge assembly according to the present disclosure.

Each of the flotation modules 105, 107 comprises a V-shaped hinge bracket 115 secured to the buoyant portions 105*a*, 107*a* for attaching to the first hinges 113 of each pair of legs 106, 108, such that each pair of legs is disposed with the included angle A therebetween in the expanded position. Each of the center column modules 101 also comprises the hinge bracket 115 for attaching to the second hinge 114 of two adjacent ones of the legs 106, 108, such that the two legs are disposed with the included angle A therebetween in the expanded position. As shown in FIG. 3*d* and the exploded view of FIG. 3*e*, in certain embodiments hinge bracket 115 comprises a front bracket portion 115*a* and a rear bracket portion 115*b* for engaging and retaining a corresponding faceted portion of a hinge 113, 114. Hinge brackets 115 can comprise; for example, metal or a pultruded composite.

Figure 4A:
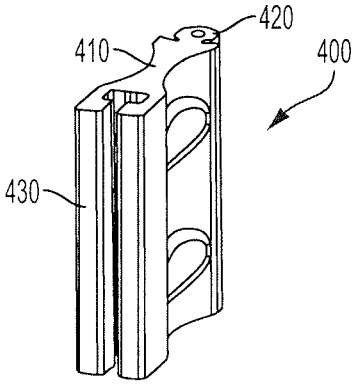
FIG. 4*a* is a perspective view of a hinge according to the present disclosure.

In certain embodiments, the hinges 113, 114 comprise EPDM rubber having a Durometer value of about 60 to about 70. An elastic portion 400 of a hinge 113, 114 according to one embodiment is shown in FIGS. 4*a-b*. The hinges 113, 114 can each have an upper and a lower elastic portion similar to elastic portion 400, each of which have a central portion 410 that performs most of the flexing, and a pair of opposed outer portions, one of which is a male faceted portion 420 and the other of which is a female receiving portion 430. Referring now to FIGS. 3*d-e*, the faceted portion 420 is for engaging a corresponding faceted track made up of the front and rear bracket portions 115*a*, 115*b* of hinge bracket 115, either by sliding faceted portion 420 into the assembled bracket 115, or by placing it between the front and rear portions 115*a*, 115*b* prior to assembly of the bracket 115.

A hinge locking pin 115*c*, such as a ¾ inch aluminum rod, is inserted in a longitudinal through-hole molded into the faceted portion 420 of each of the rubber elastic portions 400, for retaining the elastic portions 400 in the faceted track of the hinge bracket 115. Thin metal hinge support plates 115*d* are placed at the ends of the locking pin 115*c* and act as bearing plates for retainers 115*e* inserted through a transverse hole in the locking pin 115*c* near its end to retain the locking pin 115*c* in place. In this way, the hinges 113, 114 are attached to bracket 115.

Figure 3F:
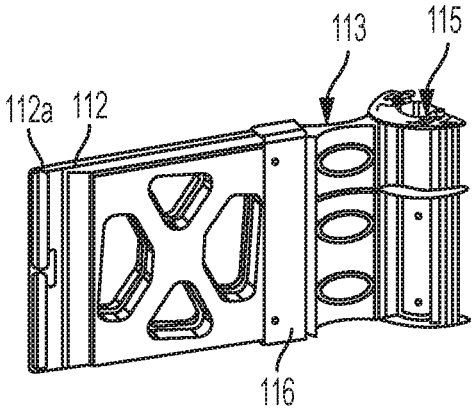
FIG. 3*f* is a perspective view of a hinge panel and V-hinge assembly according to the present disclosure.
Figure 3G:
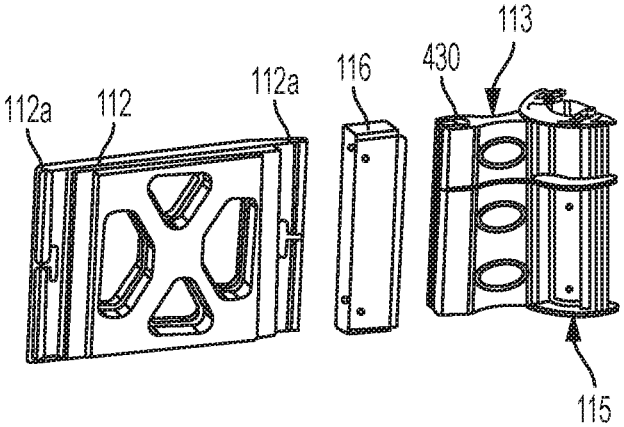
FIG. 3*g* is an exploded perspective view of the hinge panel and V-hinge assembly of FIG. 3*f*.

As shown in FIGS. 3*f-g*, the receiving portion 430 is for sliding into a corresponding faceted track 112*a* in the hinge panel 112. A hinge panel bracket 116 is then placed over receiving portion 430 and attached to hinge panel 112, as by screws or bolts, to retain receiving portion 430. As shown in FIG. 3*a*, each hinge panel 112 has a pair of hinge panel brackets 116 for attaching a pair of the hinges 113, 114 to the hinge panel 112.

The length of hinge panels 112 is scalable responsive to site-specific requirements, and/or optimized for select environmental conditions. For example, the length of hinge panels 112 can be relatively long for lower sea states and relatively short for higher sea states. This advantageous feature is made possible by the modular construction of legs 106, 108 described immediately above. Hinge panels 112 can be unbolted, removed, and replaced with panels of a different length as needed, unlike previous single net capture systems such as shown in FIGS. 8*a-b*, where all the floats, legs, and struts must be modified to make a comparable change.

Figure 4C:
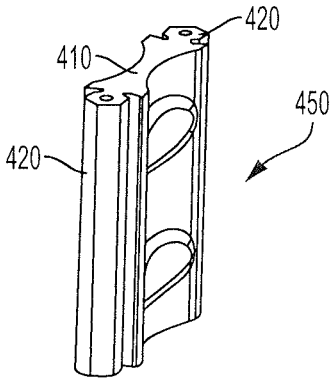
FIG. 4*c* is a perspective view of a hinge according to a further embodiment of the present disclosure.
Figure 4B:
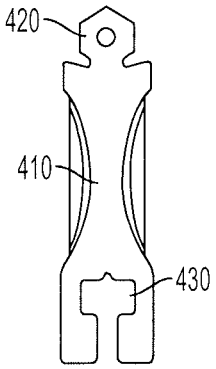
FIG. 4*b* is a top view of the hinge of FIG. 4*a*.
Figure 4D:
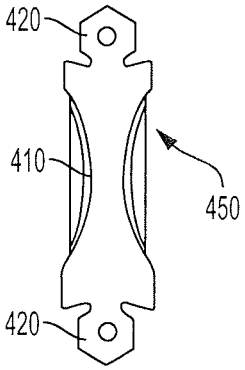
FIG. 4*d* is a top view of the hinge of FIG. 4*c*.

In a further embodiment shown in FIGS. 4*c-d*, an elastic portion 450 of hinges 113, 114 has the central portion 410 that performs most of the flexing, and a pair of opposed outer faceted portions 420. One faceted portion 420 is for engaging a corresponding faceted track made up of the front and rear bracket portions 115*a*, 115*b* of hinge bracket 115, as discussed herein above, while the other faceted portion 420 engages a corresponding faceted track in a hinge panel (not shown) that is otherwise similar to hinge panel 112.

Figure 5:
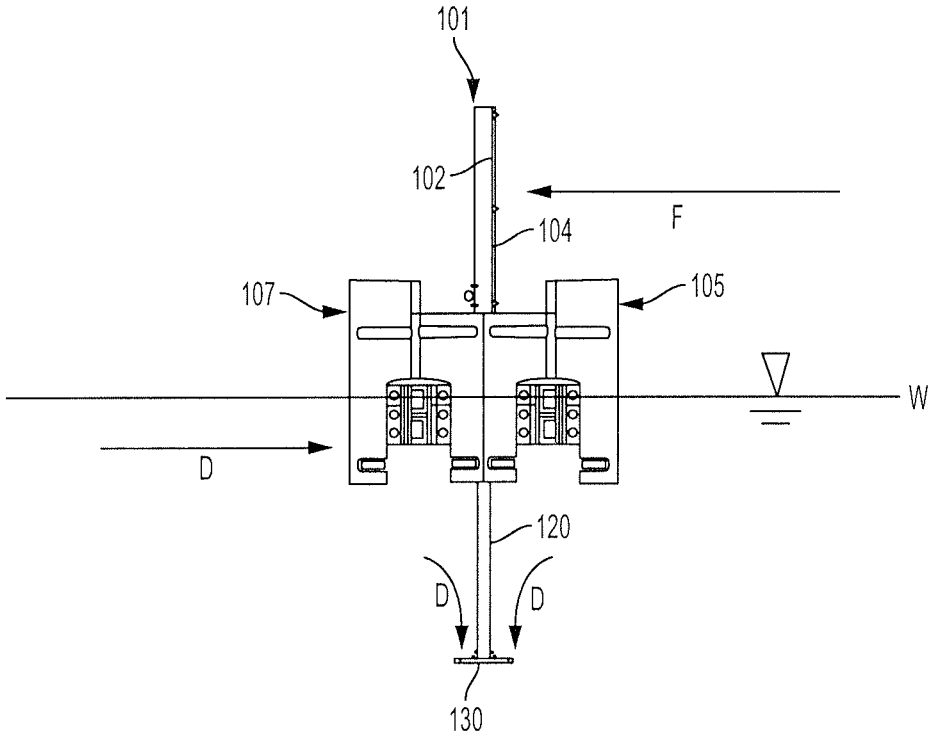
FIG. 5 is a side view of the barrier of FIG. 1, showing forces acting on the barrier.

Referring again to FIGS. 1*a-d*, in certain embodiments, each of the center column modules 101 comprises a ballast weight beam 120 extending from the bottom of the center column beam 102, and a ballast weight 130 attached to the ballast weight beam 120. Ballast weight beam 120 comprises a metal, a pultruded composite, or a plastic; for example, high density polyethylene (HDPE) or a glass filled plastic. Ballast weight 130 comprises concrete and/or a metal. Referring now to FIG. 5, when the barrier 100 is floating in the body of water, the ballast weight 130 is for counterbalancing environmental and impact loads acting on the barrier in the body of water. In certain embodiments, weight 130 is shaped to increase the structure's drag when the barrier 100 is under rapid acceleration. That is, by providing a plate-shaped weight 130, drag forces D on the barrier impede motion of the barrier in the body of water by absorbing the energy F of an impacting vessel and damping the barrier response in large wave events. Moreover, since the ballast weight 130 is rigidly attached (as opposed to being tethered as in previous systems), it reduces wear and resonance of the system. The fixed ballast also lowers the center of gravity of the system, and it remains low even during high rotation events. This increases the righting moment of the system, thus making it more stable.

Figure 1F:
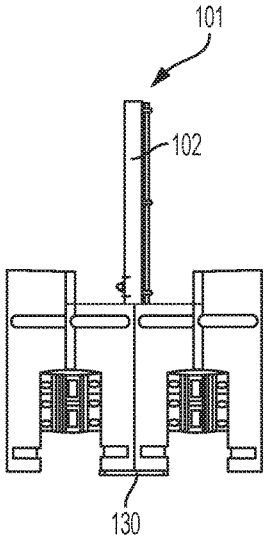
FIG. 1*f* is a side view of the barrier of FIG. 1 with the ballast retracted.

The ballast weight beam 120 is slidably retractable into a recess 102*a* within the center column beam 102 (see FIGS. 1*a* and 1*c*) to reduce an overall outer dimension of the barrier 100 during storage and shipping, and partially extendible from the recess 102*a* when the barrier is floating in the body of water. FIG. 1*f* shows the barrier 100 with the ballast weight beam 120 retracted. Ballast weight beams 120 automatically deploy (i.e., extend from recess 102*a*) via gravity a predetermined distance when the barrier 100 is floating in water or is lifted into the air, and slide into the center column beams 102 when the system is set on the ground or into a lifting cage, thereby keeping the system symmetrical and stable. The predetermined distance is set or adjusted prior to deployment of the barrier 100, depending upon the required barrier dynamics or site requirements.

In certain embodiments shown in FIGS. 1*a-b*, the ballast weight beam 120 comprises an axial groove or channel 120*a* engagable with a protrusion in the recess 102*a* of the center column beam 102 to limit the extension of the ballast weight beam 120 from the recess 102*a*. For example, in the embodiment of FIG. 3*a*, channel 120*a* cut into ballast weight beam 120 is used as a guide, and bolts 117 that fasten hinge brackets 115 and buoyant portions 103 engage channel 120*a* to act as stops for beam 120. The length of the channel 120*a* in ballast weight beam 120 determines how far the ballast weight beam 120 and ballast weight 130 will drop. In an alternative embodiment, the ballast weight beam 120 has pre-positioned holes which align with holes in center column beam 102, and are pinned by the user for site-specific adjustment.

Referring again to FIG. 6, movement of barrier 100 from its expanded position to its retracted position is accomplished by cable or line 109 which is attached to a first end one of the center column modules 101 and passes through fairleads 110 of the other center column modules 101 to a capstan or winch 111. Capstan/winch 111 draws in cable 109 to retract barrier 100, or vice versa. In certain embodiments, fully-assembled barrier 100 is retracted into a standard shipping container 600, such as a 20-feet long, 40-feet long, or 45-feet long container for shipping to a different location.

In further embodiments of the disclosed single net capture system shown in FIGS. 7*a-7d*, container 600 is replaced by a lifting cage 700 for storing barrier 100 when barrier 100 is in the retracted position. Lifting cage 700 can be transported in a container or by a flatbed truck. Similar to the embodiment of FIG. 6, a winch or capstan 111 is mounted to the lifting cage 700 remote from the first end one of the center column modules 100 and operably attached to the cable 109, for moving the barrier 100 from the expanded position to the retracted position and into the lifting cage 700.

The lifting cage 700 comprises a floor 701 for supporting the barrier 100. Floor 701 has openings or a mesh to allow water to flow through floor 701. Lifting cage 700 also comprises a lifting frame 702 attached to the top portion of the lifting cage 700 by a chain or a cable 703. The lifting frame 702 is movably attachable to a top portion of the lifting cage 700 from a secured position (shown in FIGS. 7*a* and 7*c*) where the lifting frame is proximal to the barrier 100 when the barrier is stored in the lifting cage 700, to a released position (shown in FIGS. 7*b* and 7*d*) away from the barrier 100. Lifting frame 702 is attachable to a hoist (not shown), such as a crane hoist, for lifting the lifting cage 700 and the barrier 100.

To deploy barrier 100, the lifting cage 700 is removed from its shipping container or flatbed truck. The lifting frame 702 released from the cage 700 to allow it to be raised off the top of the cage 700. Lifting frame 702 is attached to a hoist, and the cage 700 is lowered into the body of water (floor 701 is open/mesh to allow flooding). The barrier 100 is expanded via operation of the capstan/winch 111, allowing the barrier to float out of the cage 700 and the ballast weight beams 120 and ballast weights 130 to drop down from the bottom of the barrier the predetermined distance. Once barrier 100 is floating, it is towed to the deployment site by a vessel.

To recover barrier 100, the cage 700 is lowered into the body of water. Cable 109 is then fed through fairleads 110, attached to the far end one of the column modules 101, and also attached to capstan/winch 111. Barrier 100 is then retracted into the lifting cage 700 via operation of capstan/winch 111, and secured in cage 700. Cage 700 is then lifted out of the water and placed on the ground, on a truck, or in a container for storage or shipping.

Those of skill in the art will appreciate that, instead of using a lifting cage, the barrier 100 can be collapsed in the water using a stand-alone capstan or winch to pay in cable 109. Then, a single lifting beam attached to the top of barrier 100 can be used to take the barrier out of the water and place it in a container, on the ground, or on a truck for storage/shipping. Likewise, such a lifting beam and winch can be used to deploy barrier 100. The lifting beam is attached to the top of a retracted barrier 100 and, once the barrier is in the water, the lifting beam is disconnected from the barrier. Barrier 100 can then be expanded via the stand-alone winch.

Figure 7A:
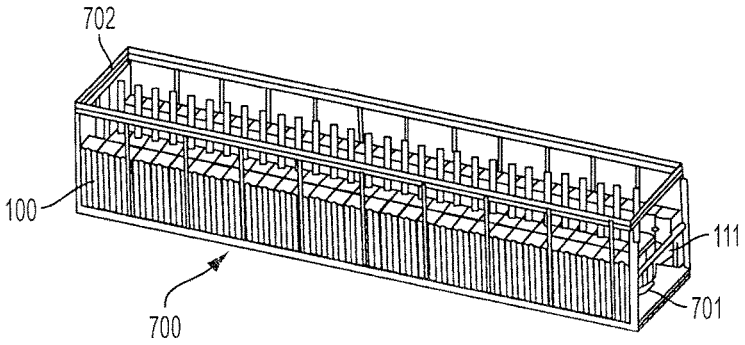
FIG. 7*a* is a perspective view of a marine barrier system of the present disclosure, including the barrier of FIG. 1 in a retracted position inside a lifting cage.
Figure 7B:
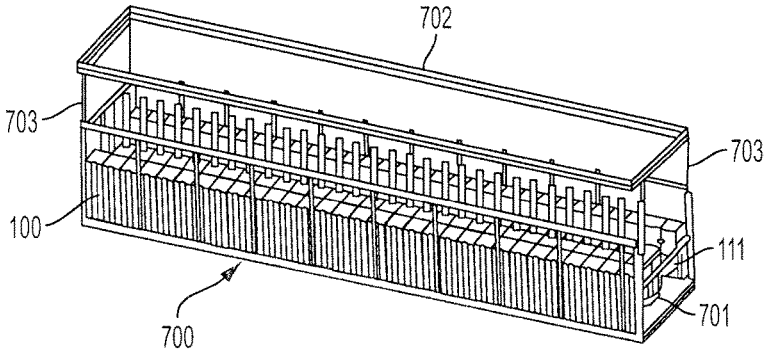
FIG. 7*b* is a perspective view of the marine barrier system of FIG. 7*a*, with a lifting frame released from the lifting cage.
Figure 7C:
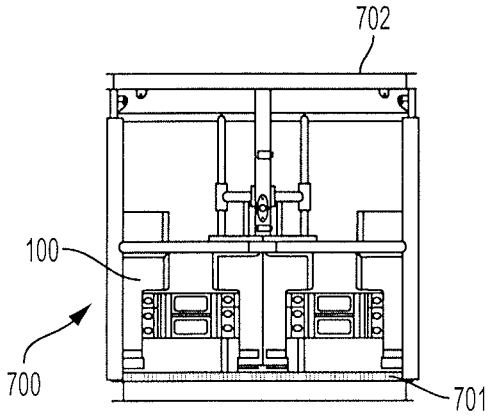
FIG. 7*c* is a side view of the marine barrier system of FIG. 7*a*.
Figure 7D:
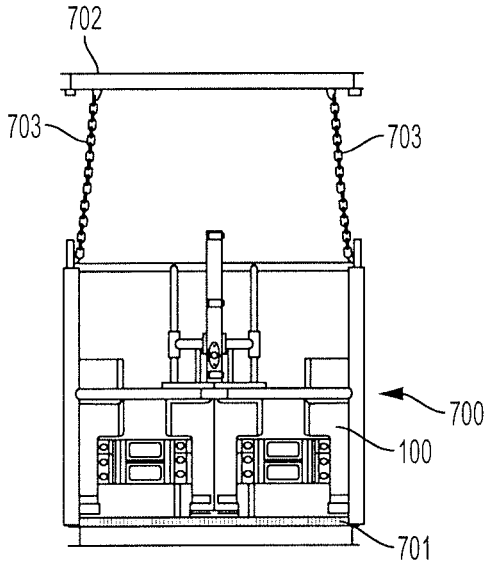
FIG. 7*d* is a side view of the marine barrier system of FIG. 7*b*.
Figure 7E:
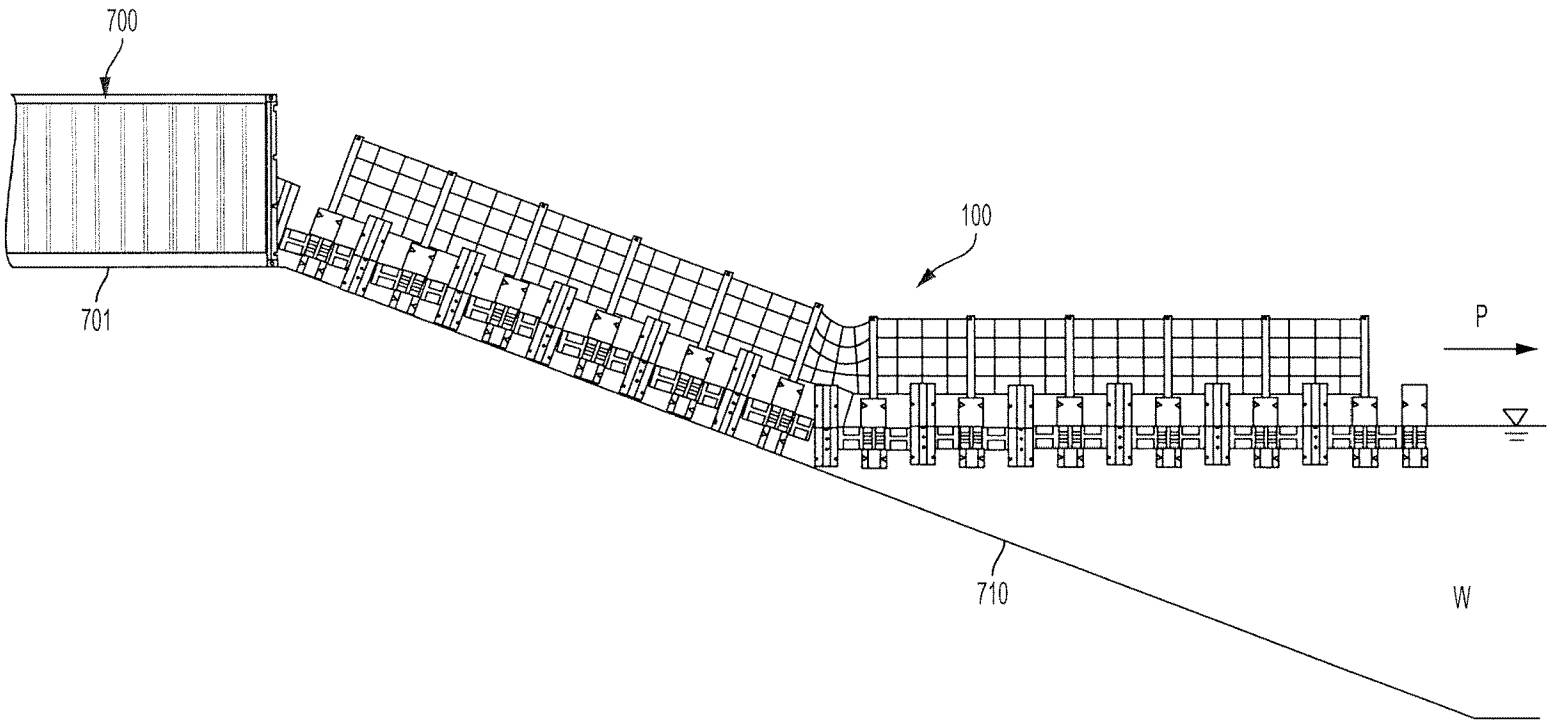
FIG. 7*e* illustrates an alternative technique of deploying and recovering the barrier system of FIG. 7*a*.

Another technique of deploying and recovering the barrier 100 can be seen in FIG. 7*e*, where the storage container or lifting cage 700 is placed on or adjacent to a boat ramp 710 or on a stern of a vessel with a ramp (not shown) and the barrier 100 is pulled out from the storage container or lifting cage 700 in the direction of arrow P. As the barrier 100 is pulled, it expands and settles into the water W. In this embodiment, the floor 701 of the container or lifting cage 700 is outfitted with rollers or low friction materials such as HDPE or Delrin plastics to ease the sliding of the barrier 100. The barrier can be recovered in a manner similar to that discussed herein above (i.e., using capstan/winch 111) to collapse and pull the barrier up the ramp 710 and into the container 700. Alternatively, a vehicle (not shown) can be used to pull the cable 109.

It is, therefore, apparent that there is provided in accordance with the present invention, a single net capture marine barrier system. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed is:

1. A marine barrier comprising:

a plurality of center column modules, each having a substantially vertical center column beam and a buoyant portion, the center column modules being spaced apart from each other and arranged in a linear fashion; and an impact net attached to each of the center column beams and extending between the plurality of center column modules;

a first plurality of flotation modules spaced from each other and arranged in a linear fashion such that the first plurality of flotation modules is substantially parallel to the plurality of center column modules;

a first plurality of legs, each leg for connecting one of the first plurality of flotation modules to one of the center column modules, wherein each of the first plurality of flotation modules has a pair of the first plurality of legs extending outwardly therefrom in opposing directions with an included angle therebetween, such that each of the first plurality of flotation modules is retained between two adjacent ones of the center column modules and offset from the longitudinal axis of the line of center column modules in a first direction;

a second plurality of flotation modules spaced from each other and arranged in a linear fashion such that the second plurality of flotation modules is substantially parallel to the plurality of center column modules;

a second plurality of legs, each leg for connecting one of the second plurality of flotation modules to one of the center column modules, wherein each of the second plurality of flotation modules has a pair of the second plurality of legs extending outwardly therefrom in opposing directions with the included angle therebetween, such that each of the second plurality of flotation modules is retained between two adjacent ones of the center column modules and offset from the longitudinal axis of the line of center column modules in a second direction opposite the first direction;

wherein each of the first and second pluralities of flotation modules includes a buoyant portion; and wherein when the barrier is floating in a body of water and a moving vessel impacts the impact net, the impact net deflects to transfer a force of the impact to one or more of the center column modules, first plurality of flotation modules, and second plurality of flotation modules, which in turn engage the water to transfer the force of the impact to the water, to arrest the motion of the vessel.

2. The barrier of claim 1, wherein each of the buoyant portions of one or more of the first and second pluralities of flotation modules and the plurality of center column modules includes an upper portion which is disposed above a waterline of the barrier when the barrier is floating in the body of water, and a lower portion disposed below the waterline, wherein the upper portion has a greater volume than the lower portion, to provide a righting moment for the barrier.

3. The barrier of claim 1, wherein each leg of the first and second pluralities of legs is for movably connecting one of the flotation modules of one of the first and second pluralities of flotation modules to one of the center column modules such that the barrier is movable from an expanded position where adjacent ones of the legs of one of the first and second pluralities of legs are disposed with the included angle therebetween, to a retracted position where the adjacent ones of the legs are substantially parallel to each other.

4. The barrier of claim 3, wherein each leg of the first and second pluralities of legs comprises a hinge panel, a first hinge for elastically connecting a first end of the hinge panel to one of the flotation modules, and a second hinge for elastically connecting a second end of the hinge panel to one of the center column modules.

5. The barrier of claim 4, wherein the first and second hinges comprise rubber.

6. The barrier of claim 5, wherein rubber comprises ethylene propylene diene monomer (EPDM) rubber having a Durometer value of about 60 to about 70.

7. The barrier of claim 4, wherein each of the flotation modules comprises a hinge bracket for attaching to the first hinges of each pair of legs, such that each pair of legs is disposed with the included angle therebetween in the expanded position, and each of the center column modules comprises the hinge bracket for attaching to the second hinge of two adjacent ones of the legs of each of the first and second pluralities of legs, such that the two adjacent legs are disposed with the included angle therebetween in the expanded position.

8. The marine barrier of claim 3, further including a cable attached to a first end one of the center column modules and passing through a fairlead of one of more of the other center column modules, for moving the barrier from the expanded position to the retracted position.

9. The barrier of claim 1, wherein each of the center column modules comprises a ballast weight beam extending from a bottom of the center column beam and a ballast weight attached to the ballast weight beam;

wherein when the barrier is floating in the body of water, the ballast weight is for counterbalancing environmental and impact loads acting on the barrier in the body of water.

10. The barrier of claim 9, wherein the ballast weight comprises a plate-shaped ballast plate to increase a drag force on the barrier to impede motion of the barrier in the body of water.

11. The barrier of claim 10, wherein the ballast plate comprises concrete or a metal.

12. The barrier of claim 9, wherein the ballast weight beam is retractable into a recess within the center column beam to reduce an overall outer dimension of the barrier, and partially extendible from the recess when the barrier is floating in the body of water.

13. The barrier of claim 12, wherein the ballast weight beam comprises an axial groove engagable with a protrusion in the recess of the center column beam to limit the extension of the ballast weight beam from the recess.

14. The barrier of claim 1, wherein the impact net comprises steel wire rope or fiber rope.

15. The barrier of claim 1, wherein the center column beams comprise a metal or a plastic resin.

16. The barrier of claim 9, wherein the ballast weight beam comprises a metal or a plastic resin.

17. A rapidly deployable marine barrier system comprising:

the barrier of claim 8; and a lifting cage for storing the barrier when the barrier is in the retracted position.

18. The system of claim 17, comprising a winch or capstan mounted to the lifting cage remote from the first end one of the center column modules and operably attached to the cable, for moving the barrier from the expanded position to the retracted position and into the lifting cage.

19. The system of claim 17, wherein the lifting cage comprises a floor for supporting the barrier, and a lifting frame for attachment to a hoist for lifting the lifting cage and the barrier;

wherein the lifting frame is movably attachable to a top portion of the lifting cage from a secured position where the lifting frame is proximal to the barrier when the barrier is stored in the lifting cage, to a released position away from the barrier to allow the barrier to float out of the cage when the cage is lowered into the body of water.

20. The system of claim 19, wherein the lifting frame is attached to the top portion of the lifting cage by a chain or a cable.

21. The system of claim 17, wherein the lifting cage comprises a floor for supporting the barrier, and the floor comprises rollers or a low friction material to ease sliding of the barrier relative to the floor.

* * * * *